US010441501B2

(12) United States Patent
Sedic

(10) Patent No.: US 10,441,501 B2
(45) **Date of Patent: *Oct. 15, 2019**

(54) MASSAGER WITH TOUCH-SENSING HEAD

(71) Applicant: LELO Inc., San Jose, CA (US)

(72) Inventor: Filip Sedic, Shanghai (CN)

(73) Assignee: LELO Inc., San Jose, CA (US)

( * ) Notice: Subject to any disclaimer, the term of this patent is extended or adjusted under 35 U.S.C. 154(b) by 414 days.

This patent is subject to a terminal disclaimer.

(21) Appl. No.: 15/428,442

(22) Filed: Feb. 9, 2017

(65) Prior Publication Data

US 2017/0151124 A1 Jun. 1, 2017

Related U.S. Application Data

(63) Continuation of application No. 13/734,908, filed on Jan. 4, 2013, now Pat. No. 9,610,215.

(51) Int. Cl.
*A61H 23/02* (2006.01)

(52) U.S. Cl.
CPC ..... *A61H 23/02* (2013.01); *A61H 23/0254* (2013.01); *A61H 2201/0153* (2013.01); *A61H 2201/5005* (2013.01); *A61H 2201/5007* (2013.01); *A61H 2201/5028* (2013.01)

(58) Field of Classification Search
CPC . A61H 1/00; A61H 7/00; A61H 7/002; A61H 7/003; A61H 7/004; A61H 7/005; A61H 7/007; A61H 2201/1207; A61H 2201/50; A61H 2201/5058; A61H 2201/5071; A61H 2201/5074; A61H 2201/5082; A61H 2230/50; A61H 2230/505; A61H 2230/65; A61H 2230/655; A61H 23/0254; A61H 2201/5028; A61H 2201/5005; A61H 2201/5007
See application file for complete search history.

(56) References Cited

U.S. PATENT DOCUMENTS

| | | | | |
|---|---|---|---|---|
| 6,443,915 | B1 | 9/2002 | Hwang | |
| 2002/0133103 | A1* | 9/2002 | Williams | A61H 19/50 601/46 |
| 2004/0030273 | A1 | 2/2004 | Tucker | |
| 2007/0185553 | A1 | 8/2007 | Kennedy | |
| 2008/0306417 | A1 | 12/2008 | Imboden et al. | |
| 2012/0165710 | A1 | 6/2012 | Nichols | |

(Continued)

OTHER PUBLICATIONS

United States Office Action, U.S. Appl. No. 13/734,908, dated Aug. 24, 2015, 10 pages.

(Continued)

*Primary Examiner* — Steven O Douglas
(74) *Attorney, Agent, or Firm* — Evan Feldstein

(57) ABSTRACT

A massager includes a massager head with a capacitive sensor. A controller uses the capacitive sensor to sense capacitance changes that indicate a human body is in close proximity or in contact with the massager head. Responsive to activating the capacitive sensor, the controller activates a massager motor in the massager head. When a human body is sensed, the controller increases the vibrations caused by the massager motor from a starting speed to a final speed through a period of time. When the capacitive sensor no longer senses a body, the massager motor is slowed down and may be stopped.

18 Claims, 2 Drawing Sheets

(56) References Cited

U.S. PATENT DOCUMENTS

| | | | |
|---|---|---|---|
| 2012/0265274 | A1 | 10/2012 | Gomez de Diego |
| 2014/0088470 | A1 | 3/2014 | Topolovac et al. |

OTHER PUBLICATIONS

United States Office Action, U.S. Appl. No. 13/734,908, dated Jun. 9, 2016, 7 pages.
United States Office Action, U.S. Appl. No. 13/734,908, dated Aug. 29, 2016, 8 pages.
Response to Office Action, U.S. Appl. No. 13/734,908, filed Aug. 11, 2016, 9 pages.
Response to Office Action, U.S. Appl. No. 13/734,908, filed Feb. 24, 2016, 88 pages (includes affidavit and exhibits).
Response to Office Action, U.S. Appl. No. 13/734,908, filed Sep. 12, 2016, 8 pages.

* cited by examiner

MASSAGER WITH TOUCH-SENSING HEAD

CROSS REFERENCE TO RELATED APPLICATIONS

This application is a continuation of U.S. non-provisional patent application Ser. No. 13/734,908, filed Jan. 4, 2013. This related application is incorporated by reference into this disclosure in its entirety.

BACKGROUND

This invention relates generally to massagers, and more particularly to massagers with a handle and a massager head.

Hand-held electric massagers provide relaxation in our busy lives. Electric massagers use a motor to provide vibration and other sensations to a human body, which can relieve tension and relax tense or tired muscles. Generally, the motor is included in the massager body, or the motor may be located in a massager head attached to the massager body.

These electric massagers typically include a power or on-off switch for the user to activate and deactivate the massager. The massagers may also include a control to determine the strength and a vibration pattern for the motor. The user generally turns the massager on and sets the desired strength and vibration pattern of the motor, such that the device vibrates at the strength and pattern set by the user when the user places the device in contact with the body. This means the device may be at a high vibration level before contacting muscles or may require the user to place the massager in the desired location and subsequently manipulate the controls to activate the massage motor.

SUMMARY

An electric massager includes a sensor that senses contact with or close proximity to a human body. The sensor is used to control a massage motor. Activation of the sensor may be used to start the motor, to increase the strength of the massage motor during the activation of the sensor up to a maximum strength of the motor, or to otherwise control the massager or its settings. When the sensor is no longer activated, such as by removing the device from contact with the human body, the action affects control over the massage motor, for example to stop the massage motor. In one embodiment, the sensor is a capacitive sensor placed within a massager head of the massager. The user may maneuver the massager using the handle, which does not include the capacitive sensor, and place the massager head on the skin near to an area of sore muscles or other portion of the body. When the massager head is placed in contact with or near the body, the capacitive sensor senses the change in capacitance and registers the presence of a body. The massage motor in the massager head is activated after the capacitive sensor senses the presence of a body, allowing the user to place the massager head on the body and begin a massage gradually and without manipulating controls after the massager head contacts the body. The gradual increase in massage strength simulates a professional massage technique applied by a human masseur and provides a better user experience.

The figures depict various embodiments of the present invention for purposes of illustration only. One skilled in the relevant art will readily recognize from the following discussion that alternative embodiments of the structures and methods illustrated herein may be employed without departing from the principles of the invention described herein.

DETAILED DESCRIPTION

Overview

Figure 1:
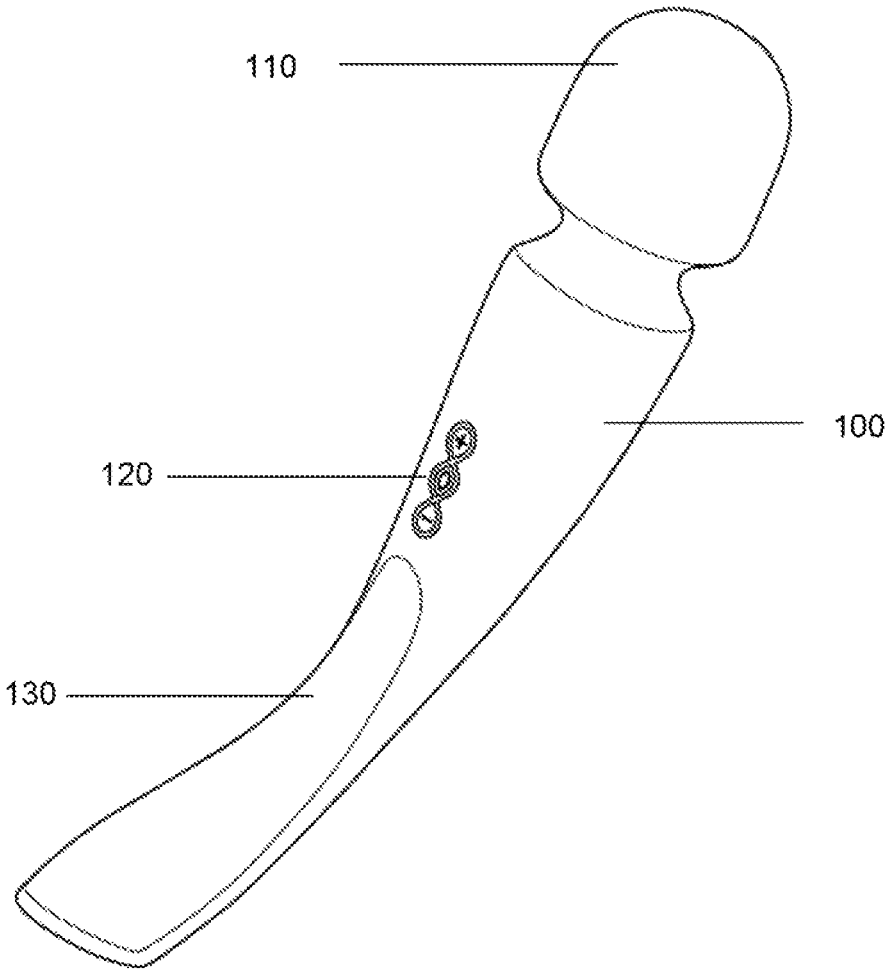
FIG. 1 is an external view of a massager according to one embodiment.

FIG. 1 is an external view of a massager according to one embodiment. The massager 100 is a hand-held cordless massager with a massager head 110. The massager also includes controls 120, and a handle 130. The massager head 110 is made of a material suitable for contact with human skin, such as a soft silicone. The massager head 110 includes a motor and a capacitive sensor. When the massager head 110 is brought into contact or close proximity with the user's skin, the capacitive sensor senses a change in capacitance due to the contact or close proximity and a controller changes the speed or vibration pattern of the motor in response to the change in capacitance.

The change in motor speed and or pattern from the contact to the user's skin may vary based on the embodiment of the massager. In one embodiment, the massager motor is off when the massager is not in contact with the skin. When the massager head contacts the user's skin and the capacitive sensor registers the contact, the controller activates the massager motor and gradually increases the massager motor vibration speed over time. Thus, when a human body is sensed, the controller increases the massager motor speed from a starting speed to a final speed over a period of time. The starting speed may be an active or a deactivated massager motor. The speed of the motor may be increased to the final speed over a period of time to increase strength of the vibrations gradually, such as over five or ten seconds. The controller may also be programmed to activate the massager motor in a pattern, such as a sinusoid or step-pattern. The amplitude or frequency of the pattern may be increased during the time the massager head is in contact with the skin. This allows the massager to change the vibration strength based on the length of time the massager is in contact with the body. The gradual increase in vibration strength of the massager allows the user to initially use a low-level (or no vibration) setting when placing the massager in contact with a human body, and increase the strength of the vibration without additional user-input. Additionally, the user can place the massager on the body when the massager is not active or when the motor is at a reduced speed, which allows the user to place the massager more comfortably than is possible with a massager that is at a higher vibration setting prior to placement.

In addition to controlling the motor when the massager is placed in contact with the skin, the motor may also be controlled when the massager is removed from the skin. Removing the massager from the skin causes the controller to reduce the speed of the motor or stop the motor fully. The speed may be reduced over a period of time or the controller may shut the motor off immediately. Certain users may prefer to use the massager discreetly, and the automatic shut-off of the massager upon removal from the skin may help in protecting user privacy if the user needs to quickly shut off the motor. Since the massager can shut itself off upon removal from the skin, it is much quicker to shut off compared to a device that must be deactivated with a manually operated switch or button.

The controls 120 are used to turn on and off, as well as to increase and decrease the motor speed, and in one embodiment are used to set a sensor-activated mode for the motor. The controls 120 may be integrated with the silicone of the massager 100. In other embodiments, controls 120 are located on a wireless controller, or the massager 100 may not include controls 120 and be controlled by the capacitive sensor.

The handle 130 provides a location to hold the massager 100. In particular, the handle is a portion of the massager 100 that does not activate the capacitive sensor. This allows the user to move and place the massager 100 without activating the massager motor through the capacitive sensor.

Figure 2:
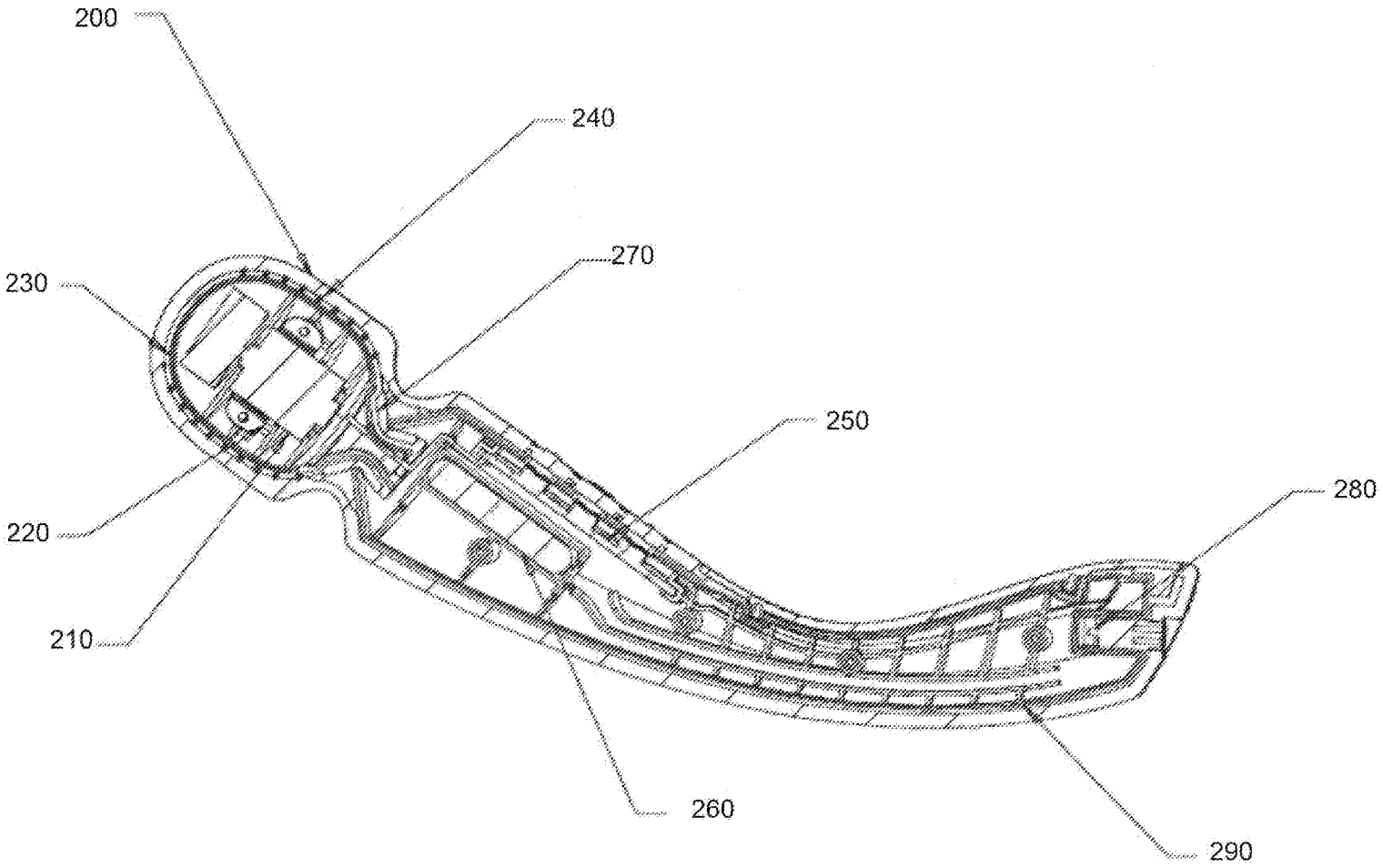
FIG. 2 is a cross-sectional view of a massager according to one embodiment.

FIG. 2 is a cross-sectional view of a massager according to one embodiment. The exterior of the main body of the massager is covered by a shell 200 that can be made of various materials, such as silicone. The massager head portion of the massager includes a massager motor 210 held by a bracket 220. The massager motor 210 and bracket 220 are enclosed in a shell 230, which can be made of plastic or other materials. The shell 230 is surrounded by a capacitive sensor 240 wrapped (or coiled) around the shell 230. The capacitive sensor is covered by the silicone 200. The capacitive sensor 240 is made of any suitable material, such as copper or indium tin oxide. The capacitive sensor 240, when operated by a controller 250, is able to sense contact or close proximity of a human body with the shell 200 covering the exterior of the capacitive sensor 240 and the body of the massager. The capacitive sensor enables the controller to discriminate between an object with high water content (e.g. a human body) and other objects. This reduces the risk of accidental activation of the sensor when not in contact with such an object.

To sense activation of the capacitive sensor 240 by a body, the controller 250 includes a relaxation oscillator. The relaxation oscillator generates a wave whose frequency changes along with the capacitance of the capacitive sensor, i.e the frequency of which increases as the capacitance of the system increases; and decreases as the capacitance of the system decreases. A counter measures the number of oscillations that occur during a fixed time period, and when the number of oscillations during the time period falls below a set level indicating a body, the controller 250 registers the presence of a body. A body may sufficiently alter the capacitance of the capacitive sensor 240 to reduce the number of oscillations below the level indicating a body even when the massager is not in actual contact with the body. Thus, close proximity of the massager to a body may register as presence of the body. The actual distance from the massager that registers as presence of the body may vary but may include a millimeter, centimeter, and in some cases an inch or more based on the number of oscillations for registering the presence of a body and sensitivity of the capacitive sensor 240.

The massager motor 210 and capacitive sensor 240 are connected to the controller 250 and a battery 260 through a grommet 270 connecting the massager head and massager body. The controller 250 in this embodiment is a printed circuit board, though in other embodiments other controllers, such as a processor, may be used. The controller 250 receives inputs from the user through the controls 120 to set the mode of operation of the massager. In other embodiments, the controls 120 can be included on a remote control or other mechanism for controlling the operation of the massager. In one mode of operation, the controller 250 uses the capacitive sensor 240 to control the movement of the massager motor 210 as described above.

The battery 260 provides for cordless operation of the massager and can be charged through a charger socket 280. In other embodiments, the massager is wired and charger socket 280 may instead include a cord for a power outlet.

The main body of the massager is also encased in a plastic shell 290 which may be covered by the silicone shell 200, in one embodiment.

The use of the capacitive sensor to activate the massager motor enables several benefits to the user of the device. The capacitive sensor enables high sensor sensitivity while also preventing many types of accidental activation. Since the contact with a human body is used to activate and deactivate the motor, timed massages are easily created by the user of the device that match a user's preferences. For example, the user may place the massager against the skin in a desired location on the body, wait for the vibrations to increase in strength, remove the massager, and re-place the massager to start a new cycle. In this way the user may create cycles of light to strong vibrations at the user's demand without requiring the user to manually manipulate the controls (which may be distracting or difficult) or using a pre-programmed frequency on the device. In addition, since this functionality allows the motor to be stopped or at a low speed when the massager contacts the body, the massager does not cause the muscle to react (i.e., contract) as may occur when a massager that is already on a high motor speed setting affects the muscle. In this way, the gradual increase of motor speed reduces the risk of contraction of the muscle, reducing possible tension caused by any such contraction, and thus providing a more comfortable massage, similar to that of a human masseur.

Though shown in this embodiment as including a massager motor and capacitive sensor in a massager head, other arrangements may also be used. For example, one embodiment may use no distinct massager head and instead use a main massage body to house the controller, motor, and capacitive sensor. In addition, the capacitive sensor may be located on a portion of the massager that does not enclose or surround the massager head and may be located at any suitable portion of the massager that a designer chooses to affect the motor speed or pattern. The massager can also have a variety of different shapes and designs, and the figures provide just one example arrangement for the massager. The capacitive sensor can also be used to control other settings of the massager, such as to activate a particular setting or vibration pattern or tempo upon registering contact with the body. For example, the user may have a preferred vibration pattern that begins or is increased upon contact with the body, and the user can use the controls to re-set the preferred pattern such that a different pattern will begin or increase upon body contact.

SUMMARY

The foregoing description of the embodiments of the invention has been presented for the purpose of illustration; it is not intended to be exhaustive or to limit the invention to the precise forms disclosed. Persons skilled in the relevant art can appreciate that many modifications and variations are possible in light of the above disclosure.

The language used in the specification has been principally selected for readability and instructional purposes, and it may not have been selected to delineate or circumscribe the inventive subject matter. It is therefore intended that the scope of the invention be limited not by this detailed description, but rather by any claims that issue on an application based hereon. Accordingly, the disclosure of the embodiments of the invention is intended to be illustrative, but not limiting, of the scope of the invention, which is set forth in the following claims.

What is claimed is:

1. A massager configured for control based on proximity to a human body, comprising:

a massager body;

a massager motor disposed within the massager body and capable of a plurality of operating speeds;

a capacitive sensor disposed within the massager body and configured for sensing proximity with the human body at least a portion of the massager body; and a controller disposed within the massager body for operating the massager motor, the controller configured to change the operating speed of the massager motor, wherein the controller increases the operating speed of the massager motor from a zero operating speed to an initial non-zero operating speed responsive to the capacitive sensor sensing close proximity with the human body, the controller increases the operating speed of the massager motor from the initial non-zero operating speed to a greater non-zero operating speed responsive to the capacitive sensor sensing sustained close proximity with the human body, and the controller decreases the operating of the massager motor responsive to the capacitive sensor no longer sensing proximity with the human body.

2. The massager of claim 1, wherein the controller configured to turn the massager motor on and off.

3. The massager of claim 1, further comprising a user control configured to select a motor pattern of plurality of motor patterns for the massager motor.

4. The massager of claim 3, wherein the plurality of motor patterns includes a step motor pattern.

5. The massager of claim 3, wherein the plurality of motor patterns includes a sinusoid motor pattern.

6. The massager of claim 1, wherein the massager body includes a first segment coupled to a second segment via a grommet, wherein the massager motor is disposed within the first segment covered by a shell, and wherein the second segment is greater in length than the first segment.

7. The massager of claim 6, wherein the capacitive sensor is disposed within the first segment.

8. The massager of claim 7, wherein the capacitive sensor is coiled around the shell.

9. The massager of claim 8, wherein the controller is disposed within the second segment.

10. The massager of claim 9, further comprising a battery disposed within the second segment and configured provide cordless operation of the massager.

11. The massager of claim 10, further comprising a silicone shell that covers at least a portion of the massager body.

12. A massager configured for control based on proximity to a human body, comprising:

a massager body;

a massager motor disposed within the massager body and capable of a plurality of operating speeds;

a capacitive sensor disposed within the massager body and configured for sensing proximity with the human body of at least a portion of the massager body; and a controller disposed within the massager body for operating the massager motor, the controller configured to turn the massager on and off, the controller configured to change the operating speed of the massager motor, wherein the controller increases the operating speed of the massager motor from a zero operating speed to an initial non-zero operating speed responsive to the capacitive sensor sensing close proximity with the human body, the controller increases the operating speed of the massager motor from the initial non-zero operating speed to a greater non-zero operating speed responsive to the capacitive sensor sensing sustained close proximity with the human body, and the controller stops operation of the massager motor responsive to the capacitive sensor no longer sensing proximity with the human body.

13. The massager of claim 12, wherein the massager body includes a first segment coupled to a second segment via a grommet, wherein the massager motor and the capacitive sensor are disposed within the first segment and covered by a shell, and wherein the capacitive sensor is coiled around the shell.

14. The massager of claim 13, wherein the controller is disposed within the second segment.

15. A method for controlling a massager configured to be used by a user having a human body, comprising the steps of:

sensing close proximity with the human body by a capacitive sensor associated with at least a portion of a massager;

increasing an operating speed of a massager motor of the massager from a zero operating speed to an initial non-zero operating speed in response to the sensing of close proximity with the human body;

increasing the operating speed of the massager motor from the initial non-zero operating speed to a greater non-zero operating speed responsive to the capacitive sensor sensing sustained close proximity with the human body; and decreasing the operating speed of the massager motor of the massager responsive to the capacitive sensor no longer sensing close proximity with the human body.

16. The method claim 15, wherein the steps of increasing the operating speed of the massager motor occur automatically and without manipulation of a user control.

17. The method of claim 16, wherein the step of decreasing the operating seed of the massager motor occurs automatically and without manipulation of a user control.

18. The method of claim 15, further comprising the step of stopping operation of the massager motor of the massager responsive to the capacitive sensor no longer sensing close proximity with the human body.

* * * * *